US007618209B2

(12) United States Patent
Tavares da Silva

(10) Patent No.: US 7,618,209 B2
(45) Date of Patent: Nov. 17, 2009

(54) COSMETIC DISPENSER HOUSING AND METHOD

(75) Inventor: Reginaldo Alexandre Tavares da Silva, Seacroft (GB)

(73) Assignee: Conopco, Inc., Englewood Cliffs, NJ (US)

( * ) Notice: Subject to any disclaimer, the term of this patent is extended or adjusted under 35 U.S.C. 154(b) by 663 days.

(21) Appl. No.: 11/184,655

(22) Filed: Jul. 19, 2005

(65) Prior Publication Data

US 2006/0018703 A1 Jan. 26, 2006

(30) Foreign Application Priority Data

Jul. 20, 2004 (GB) ..... 0416250.9

(51) Int. Cl.
*B43K 7/10* (2006.01)

(52) U.S. Cl. ..... 401/216

(58) Field of Classification Search ..... 401/208, 401/209, 212–216
See application file for complete search history.

(56) References Cited

U.S. PATENT DOCUMENTS

| | | | | |
|---|---|---|---|---|
| 2,823,403 A | | 2/1958 | Whitney | 15/132.7 |
| 2,858,558 A | | 11/1958 | Sudbeaz | 15/132.7 |
| 2,968,826 A | | 1/1961 | Leshin | 15/132.7 |
| 3,069,718 A | | 12/1962 | Brady et al. | 15/571 |
| 3,075,230 A | | 1/1963 | Merchant | 15/571 |
| 3,111,703 A | | 11/1963 | Kaufman | 15/572 |
| 3,284,839 A | | 11/1966 | Cook | 15/541 |
| 4,002,411 A | | 1/1977 | Harbauer | 401/213 |
| 5,154,525 A | | 10/1992 | Matsuo | 401/209 |
| 5,213,431 A | | 5/1993 | Gentile et al. | 401/219 |
| 5,810,495 A | | 9/1998 | McAuley | 401/214 |
| 5,897,267 A | * | 4/1999 | Poolman et al. | 401/214 |
| 6,155,736 A | | 12/2000 | Evans et al. | 401/219 |
| 6,179,505 B1 | | 1/2001 | Oder, III et al. | 401/213 |
| 6,488,431 B1 | * | 12/2002 | Bocola | 401/216 |

FOREIGN PATENT DOCUMENTS

| | | | |
|---|---|---|---|
| CA | 1078783 A | * | 6/1980 |
| DE | 1 020 776 | | 4/1954 |
| DE | 90 12 721 | | 2/1992 |

(Continued)

OTHER PUBLICATIONS

European Search Report in an EP application EP 04 25 4334.

(Continued)

*Primary Examiner*—Huyen Le
(74) *Attorney, Agent, or Firm*—Karen E. Klumas

(57) ABSTRACT

Doses of cosmetic fluid dispensed from a roll-on dispenser can fluctuate significantly between successive applications. This problem can be alleviated by perturbing flow within the roll-on housing, such as air flow, by forming flow perturbators on the interior side-wall of the housing. These perturbators can alternatively or additionally comprise lateral beads or notching an interior sealing ring. The dispenser housing preferably also includes a spider normally located between the roller and the bottle interior, and preferably a resilient spider having an facing surface parallel with the roller that can control the depth of liquid film adhering to the roller, which when the roller is a ball means a concave upper face of similar radius of curvature to that of the ball.

24 Claims, 5 Drawing Sheets

FOREIGN PATENT DOCUMENTS

| | | |
|---|---|---|
| DE | 198 27 965 | 12/1999 |
| DE | 201 19 329 | 1/2000 |
| DE | 299 14 452 | 1/2000 |
| DE | 102 11 483 | 9/2003 |
| EP | 0 046 038 | 2/1982 |
| EP | 528 265 | 2/1993 |
| GB | 1115861 | 5/1968 |
| GB | 1 515 078 | 6/1978 |
| GB | 2 082 124 | 3/1982 |
| GB | 2 255 052 | 10/1992 |
| GB | 2 268 912 | 1/1994 |
| WO | 95/24141 | 9/1995 |
| WO | 02/051283 | 7/2002 |
| WO | 2005/079621 | 9/2005 |

OTHER PUBLICATIONS

PCT International Search Report in a PCT application PCT/EP 2005/007377.

GB Search Report in a GB application GB 0416251.7.

Derwent Abstract of DE 201 19 329—published Feb. 28, 2002.

Derwent Abstract of DE 102 11 483—published Sep. 25, 2003.

Co-pending Application: Applicant: Tavares da Silva; U.S. Appl. No. 11/184,489, filed Jul. 19, 2005.

* cited by examiner

COSMETIC DISPENSER HOUSING AND METHOD

The present invention relates to a cosmetic dispenser housing and more particularly to improvements to a housing for a ball suitable for attachment to a bottle or reservoir to form a roll-on dispenser for a cosmetic liquid. The invention also relates to a method for smoothing the dosage of a cosmetic liquid from a hand-held cosmetic roll-on dispenser.

BACKGROUND TO THE INVENTION

Herein the term fluid indicates a material other than a gas which is capable of flowing without retaining its physical shape and accordingly excludes firm solids which retain their shape when subjected to mild pressure. The term includes liquids or creams which may be aqueous or anhydrous and flowable particulate solids. In particular, the present invention is directed to dispensers of a liquid of low or intermediate viscosity.

One class of dispensers of cosmetic fluids, including in particular deodorants and antiperspirants is commonly called a roll-on dispenser or applicator. In such dispensers, a bottle or reservoir has an outlet aperture which is shaped to form a housing for a rotatable roller, commonly a ball. The roller is retained by the housing, having a fraction of its surface in fluid connection with the reservoir or bottle and a further fraction of its surface exposed outside the housing. In use, the roller can rotate within the housing, thereby conveying liquid from within the reservoir to outside the housing where it can be brought into contact with skin (or some other chosen surface). Although in some instances the housing is formed together with the reservoir or bottle, it can alternatively be formed as a separate unit which is attached to the bottle by a suitable means, such as co-operating screw threads, or more usually by snap fit co-operating moulded lateral beads on the respective contact surfaces of the housing and bottle, e.g. to assist manufacture and/or assembly of the dispenser.

Conventionally, roller housings also include one or more means to seal the dispenser and prevent liquid egress past the roller when a cap has been fitted. These sealing means can comprise an annular sealing ring located on the interior surface of the housing between the roller and the reservoir of the bottle onto which ring the roller is urged by axial pressure exerted by the cap, usually by an annular wall depending from the interior of the top of the cap that contacts the roller.

Although roll-on dispensers have been used or proposed for use for at least 50 years, little attention, if any, has been given in prior publications to the simultaneous counter-flow of liquid out of the dispenser and the inflow of air into the bottle reservoir through the relatively narrow annular space between the roller and the interior of the housing. One of the problems that has recently been identified comprises an unpredictable fluctuation in the dosage of a liquid by a cosmetic roll-on of conventional size. Without being bound to any particular theory or explanation, it is believed that the unpredictable fluctuations arise at least partly as a result of the intermittent creation and release of a partial vacuum in the reservoir or housing when liquid is withdrawn by the roller and deposited on skin. When the partial vacuum is formed, the roller tends to be brought into contact with or at least pulled towards the annular ring on the inner surface of the housing restricting the flow of liquid. Variations in the extent of the partial vacuum are possible. However, irrespective of the precise explanation for fluctuations, it would be desirable to provide a dispenser which ameliorated such fluctuations.

A liquid applicator with a sealing ring against which the balled is pressed by the cap is described in U.S. Pat. No. 5,810,495. However, there is no recognition in U.S. Pat. No. 5,810,495 of the problems of variable fluid flow within the housing variable product dispensation and consequently no attempt is made to cure or ameliorate such problems. Indeed, the patent discloses the use of a valve inward of the ball housing which could easily exacerbate flow problems.

It has also been proposed in a number of patent specifications relating to roller/roll-ball dispensers to incorporate within the roller/ball housing a sealing ring and/or an intermediate reservoir underneath the roller/ball. The latter is able to retain fluid whilst the dispenser is in an upright orientation, for example as described in GB 1115861, GB 2255052, GB 2268912A, DE 19827965A, DE 20119329A, DE 29914452, U.S. Pat. No. 3,075,230, U.S. Pat. No. 3,069,718, U.S. Pat. No. 3,111,703, U.S. Pat. No. 324,839, U.S. Pat. No. 6,155,736 and U.S. Pat. No. 6,179,505, amongst others. There is no recognition in such specifications of the problems of air/gas flow within the interior surface of the housing and, consequently, no attempt was made to cure or ameliorate such problems in the specifications. Indeed, the very presence of an intermediate reservoir with limited inlet area could easily exacerbate flow problems.

It is an object of the present invention to reduce liquid dose fluctuations from a roll-on liquid dispenser having a removable cap and in particular from dispensers comprising a sealing ring against which a rotating roller is pressed by fitting the cap.

STATEMENT OF INVENTION

According to a first aspect of the present invention, there is provided a roll-on dispenser for a liquid in claim 1 herein.

According to a second of the present invention there is provided a method for ameliorating dose fluctuations from a roll-on dispenser as described in claim 19 herein.

As a result, so it is believed, of the flow of the gaseous and/or liquid fluids within the housing being perturbed by the perturbator or perturbators on the interior surface of the housing at or outward from the sealing ring, the fluctuations in liquid dosing by the dispenser tend to be reduced, which is to say that any peaks or troughs tend to be noticeably smaller than when employing a conventional roller housing.

Herein the term "inward" when employed axially, for example in "inward end" in respect of a housing intended for mounting on or an integral mounding with a bottle reservoir refers to the end adjacent to the interior of the bottle, and outward is that remote from the bottle interior. Axial relates to an axis extending centrally through the inward and outward ends of the housing.

Herein, the terms upward, downward, above and below when employed in respect of the dispenser and its constituent parts refer to when the dispenser is in an upright orientation, which is to say the cap is above the bottle.

DETAILED DESCRIPTION OF THE INVENTION AND OF PREFERRED EMBODIMENTS

The present invention is directed to improving the control of the flow of liquid from a roll-on dispenser by modifications to the interior surface of the housing for the roller from its sealing ring through to its outward end, which result in localised disruption of or modification the flow of fluids across that surface in the housing chamber.

Herein, the invention is described with particular reference to the roller being a ball, and especially to a spherical ball.

However, the skilled person can similarly introduce perturbation into the fluid flow through housings for non-spherical balls or cylindrical rollers, the dimensions and shape of the housing been adapted to accommodate such alternative rollers. References herein to a ball in relation to the instant detailed description and preferred embodiments may accordingly be read to include such alternatives, except where indicated.

The interior surface of the housing chamber can be modified in a number of different ways to perturb fluid flow over the surface. This can comprise the introduction of baffles, preferably baffles on the interior face which can possibly introduce turbulence into the fluid flow. Conveniently, the baffles can comprise one or more continuous or discontinuous lateral beads intermediate between the outward end of the housing and the lateral sealing ring. If desired, the beads can also be castellated or have an axial component, as for example the beads being arranged in chevrons or spirals, and/or in an array of short sections distributed symmetrically or randomly across the interior face of the housing. The beads commonly have a depth of from about 50 to 500 μm, so as to achieve fluid perturbation but not obstruct the outward of flow of liquid from the dispenser excessively. Where lateral beads are employed, such as two beads, they can desirably be parallel, and their axial spacing from each other is often selected in the range of from 2 to 8 mm such as from 2.5 to 4.5 mm. The only bead or closest bead is often in the range of from 2 to 8 mm axially outward from the sealing ring and particularly from 2.5 to 4.5 mm. The only bead or closest bead is often from 5 to 10 mm axially inward of the outward end of the housing.

A further and particularly desirable way in which the ball housing surface can be modified to cause fluid perturbation in the chamber comprises notching the lateral sealing shelf with a multiplicity of axially extending notches at its upward edge i.e. the edge pointing towards the outward end of the housing. In the instance of a ball, the sealing shelf is simply an annular ring, whereas for a cylindrical roller, the shelf not only comprises a lateral shelf extending along each side of the cylinder, in effect a ring, but also may extend beneath the roller adjacent to each cylinder end. The notches are dimensioned to cause fluid turbulence, desirably having sharp edges, such as from 90 to 110°, preferably square edged. The notches are often rectangular, possibly with tapering sides. The notches are preferably made all around the sealing ring, and especially they are approximately equidistant from their neighbours. The number of notches is at the discretion of the manufacturer, but preferably selected to provide a spacing in the range of from 2.5 to 7.5 mm and particularly in the range of from 3 to 5 mm for hand-held cosmetic dispensers employing a roll-ball of from 25 to 36 mm diameter such as is particularly suitable for dosing cosmetic products such as deodorants and antiperspirants. For a sealing ring having a circumference of from 90 to 110 mm, this indicates the number of notches conveniently being in the range of from 15 to 36, such as particularly from 20 to 30.

The notches are dimensioned and profiled, in practice, so as to encourage fluid turbulence. The width of each notch is often from about 250 or 500 to 2000 μm, such as from 750 to 1500 μm. The axial depth of each notch is often at least 500 μm and commonly not greater than 2500 μm, and in a number of preferred embodiments is from 1200 to 1600 μm. The notches advantageously have a sharp outward edge, such as from about 85 to 110°, and preferably square edged. The notches themselves are commonly rectangular in cross section, possibly having tapering sides.

Advantageously, the notches on the sealing shelf (ring) are in fluid connection with an annular, preferably v- or u-shaped groove formed in the side-wall of the housing beside the upward-facing edge of the sealing ring and. This lateral v- or u-shaped groove conveniently has a width (at its upward end, i.e. its mouth) and axial depth which are each desirably selected in the range of from 500 to 2500. Its depth is advantageously similar to the depth of the notches in the sealing ring, and preferably is the same.

Advantageously, the housing employs both the baffles and the notched sealing ring.

The invention method advantageously comprises creating turbulent fluid flow during at least a fraction of the fluid path between the sealing shelf and the outward open end of the housing, and especially a fraction that is greater than half the length of said pathway.

The instant invention may in at least some embodiments be considered to comprise the provision of a housing for a roll-on which comprises one or more baffles such as a bead or beads as described herein and/or, especially, the notching of the outward facing edge of a sealing ring on the interior face of the housing as described herein, particularly when it is in communication with an annular groove, irrespective of the reason why they smooth variations in the dose of a cosmetic liquid applied by the dispenser.

The housing can additionally have, mounted therein, a spider positioned between the sealing shelf and the interior of the bottle. Such a spider can comprise a plurality of spokes, optionally with an intermediate ring linking two or more of the spokes. The spokes can be fixed, that is to say have both ends secured, for example one end being mounted on the interior face of the housing and the other end fixed to a hub, or can be free, which is to say has one end fixed, for example being mounted to the housing wall or to the aforementioned hub. The spider can have a flat, concave or convex profile facing the roller.

However, it is particularly desirable to employ a spider having a top surface parallel with that of the roller which when the roller is a ball means a convex profile and especially a spider in accordance with the disclosure in a co-pending application of even date entitled "Improvements in a Cosmetic Dispenser", any supplementary description and accompanying drawings compared with the present text and drawings being incorporated herein by reference. Use of such a particularly desirable spider, that can wipe excess liquid off the ball to leave a film of pre-determined depth, can contribute to the reduction of fluctuations between successive topical applications of the cosmetic formulation.

A spider herein comprises a plurality of spokes which can as a minimum be two, provided that together they subtend a wide arc of the housing, such as preferably at least 120 through to 240 degrees and preferably are at or close to 180 degrees apart. Preferably, the number of spokes is at least 3. and in some instances, the number of spokes is at least 4 The number of spokes is normally no greater than 12, in so as not to constrict the passage of liquid between the spokes unduly, and in several preferred embodiments is not more than 9. A convenient number is 3, 4, 5 or 6 spokes, and especially 6 spokes. Although the spokes can be arranged asymmetrically around the interior of the housing side-wall, it is preferable to employ a symmetrical arrangement, for example point or mirror symmetry.

The spider can be mounted on the interior of the housing side-wall one or more mounting points. When a single mounting point is employed, the spoke leading away from the mounting point terminates at its opposed end in a hub from which radiates at least one further spoke, and preferably from 2 to 5 further spokes. Preferably the spider is mounted on the side-wall at two or more mounting points that themselves are preferably symmetrically arranged around the interior side-wall and conveniently by 3 or 4 mounting points. The mounting points are most desirably equidistant around the housing side-wall and lateral relative to each other, i.e. all at the same axial distance below the widest diameter of the housing.

In many embodiments, the spider comprises a hub from which spokes radiate towards the housing side-wall. If desired, all the spokes can extend between the side-wall and the hub, and for convenience herein these can be called fixed spokes. However, some of the spokes that radiate from the hub and spokes that radiate towards the centre of the housing from the side-wall can have a free end, by which free end is meant that it is not secured to respectively the side-wall or the hub, and for convenience herein these can be called free spokes. It is preferred to employ a mixture of free and fixed spokes, for example in a ratio of from 1:2 to 2:1, and conveniently at 1:1. The free spokes tend to be more flexible whereas the fixed spokes tend to be more rigid and assist in the production of the combined housing and spider, for example in injection moulding. It is especially desirable for fixed and free spokes to arranged symmetrically, such as 1 or 2 free spokes interposed between adjacent fixed spokes. By adopting a symmetrical arrangement, the ball can be centred more easily, thereby ensuring best that the spokes control the depth of liquid film more evenly. One especially desirable arrangement comprises an even number of spokes in total being 4, 6 or 8 having alternate fixed and free spokes symmetrically arranged around the side-wall.

The spider desirably has a means for providing localised contact with the ball and especially when it has a concave upward, ball-facing surface. Preferably, the spider, is resilient and flexible, at least in an axial direction, or constituent spokes thereof, and mounted so as to bias the ball upwardly, thereby keeping the spider in localised contact with the ball, when the cap is removed. The downward force exerted on the ball maintains contact between ball and spider when the cap is fitted, flexing downwardly the spider, or at least the spokes carrying the boss or pimple.

The localised contact means desirably comprises a boss or pimple standing proud of the surface of the spider, specifically proud of the surface of the spokes facing the ball. The boss or pimple is desirably of round or rounded lateral cross section. The boss or pimple advantageously has a bevelled or rounded chamfer to its contact edge with the ball, thereby to minimise frictional contact with the ball. The boss or pimple advantageously is hemispherical or a cylinder terminating in a hemisphere. The orthogonal height of the pimple, which controls the depth of the liquid film adhering to the ball, is often, for a hand-held cosmetic dispenser, selected in the range of from 300 to 2000 μm and in many instances from 350 to 750 μm.

The pimple or boss often has a diameter of from 300 to 2500 μm and particularly from 350 to 1000 μm, often tapering or rounded to a point (such as below 25 μm diameter) for contact with the ball. The boss or pimple can be employed on free or fixed spokes and on the hub. Advantageously, at least one pimple or boss per spoke is located at a point that is remote from the point of attachment of the spoke, he free to the hub and the fixed to the housing side-wall as the case may be. Particularly desirably each free spoke has a pimple. Most desirably, the pimples present a symmetrical pattern. If desired any spoke can be provided with a plurality of pimples, such as 2 or 3. Preferably when the housing comprises an annular sealing ring between the ball and the spider mounting point(s), any pimple on a spoke mounted on the wall is equidistant between the wall and centre of the housing or closer to the centre.

Alternatively, for a free spoke, the means for spacing the spoke surface from the ball surface can comprise the tip of the spoke being bent upwardly towards the ball, desirably to provide a similar spacing to that provided by a pimple. In the vicinity of the hub, the localised contact can be provided by an upstanding wall that is either continuous or discontinuous and concentric with the housing side-wall. Desirably a free spoke extends at least about 40% the radius of the interior of the housing, so as to be relatively flexible. In many embodiments the free spoke extends up to 95% of the housing interior radius and especially from 75 to 95% particularly when it extends from a hub. When it extends from the side-wall, the free spoke particularly extends from 50 to 80% of the housing interior radius.

The spokes desirably have a triangular side profile with a concave top wall preferably matching the radius of the ball with the apex of the triangle at the hub, or closest to the hub for a free spoke that is mounted on the side-wall. Such a profile assists the spoke to flex whilst strengthening it adjacent to its mounting point. The spokes can desirably comprise an upstanding wall, often tapered and a base plate, providing a T-shaped cross section.

Preferably, the concavity of the ball-facing top surface of the spokes has a similar radius to that of the ball so as to enable the film depth to be substantially the same along the length of the spokes. The mounting point of the spokes on the side-wall is such that the ball is radially spaced from the mounting point at the same height as the pimple or like gap-forming means.

The resilient spider often provides a contact force (acting upwardly on the ball) of from 0.01 to 0.1 kg-f and especially in the region of 0.04 to 0.06 kg-f, a force sufficient to maintain contact, but not so great as to render operation of the dispenser difficult.

Advantageously, the spokes of the spider taper slightly from base to tip. This feature enables the sides of the spoke adjacent to its tip to extend at or close to the radial direction of the ball, for example within about 10 degrees, thereby enabling the tip to encounter the liquid film adhering to the ball approximately orthogonally. The spokes have a surface between their sides, albeit it narrow, which faces the ball surface. Both features assist the spoke to act as a wiper blade. By contrast, if the encounter angle were much less, say between 30 or 60 degrees, providing a corner, its ability to act as a wiper would be compromised.

In practice, when the dispenser is employed in a conventional manner by users, most conveniently, the spacing between the spider and the ball, for example as defined by the height of the pimple or boss, is less than the spacing between the ball and the housing, even at its tip. That way, the spider controls the depth of fluid adhering to the ball.

The invention is directed in particular to the use of balls having a diameter of from about 20 to about 40 mm and especially from about 25 to about 36 mm. Representative ball diameters are 25, 29, 32 or 35.5 mm, or thereabouts.

The housing and spider are preferably injection moulded together in a unitary mould, employing a thermoplastic polymer such as polyethylene or polypropylene.

The housing is intended as an outlet for a roll-on bottle, the term encompassing related reservoirs such as pouches. Because the invention housing has a spider in its inward end, it is most convenient to form the housing separately from the bottle and attach the one to the other as is recognised in the art. Such means of attachment can comprise a friction fit, though preferably employing a snap fit in which a bead snaps into a corresponding groove or over a mating bead to secure the two items together. Alternatively, the housing and bottle attached by co-operating screw threads. Where a non-releasable attachment is sought, the two components can be bonded by an adhesive. Although the housing is preferably made from a thermoplastic, the bottle can be made from any of the materials which have hitherto been used to make a cosmetic bottle or proposed for such use. Such materials include thermoplastics, glass and even metals.

A cosmetic dispenser fitted with a housing according to the present invention normally is fitted also with a cap that is positioned over the housing and generally provides in co-operation with the housing and/the ball, a sealing means to prevent egress of liquid from the dispenser. The cap can be attached directly onto the bottle or housing. It can comprise a top wall having a centrally located dependent wall that is intended to contact the ball during the capping operation and urge it towards the inward end of the housing, particular to engage with a sealing ring as described hereinabove. Alternatively or additionally it can comprise a dependent skirt or a dependent annular wall close to the skirt which is dimensioned to engage the outer side of the side-wall of the housing adjacent to its outward end and compress the side-wall onto the ball.

The cap can be affixed to the bottle or housing by a screw-thread system or alternatively by a bayonet system, for example as described in the text and drawings of a co-pending application of even date entitled "Attachment means for a Cosmetic Dispenser" which is incorporated herein. The present invention is suitable for a hand-held cosmetic dispenser, that is say one holding preferably from about 20 to 120 mls as is common for a deodorant or antiperspirant. An especially desirable bottle contents is for from 40 to 75 mls liquid. The bottle body (reservoir) can be any shape of body previously employed or proposed for employment in a roll-on cosmetic dispenser, and particularly for dispensing a deodorant or antiperspirant. Examples of suitable bottles include bottles in which the ball housing or bottle head is moulded separately from the reservoir or body, a choice that is especially preferred when the housing additionally comprises a spider, advantageously snap-fitted to the reservoir, or the housing and reservoir can be integrally moulded together. The body can adopt any shape dictated by aesthetic considerations, such as for example a cylinder which may be circular or oval in lateral cross section, possibly having opposed faces scalloped, or the body may adopt one or more degrees of asymmetry, such as a dispenser having a head bottom wall and a body side-wall intersecting at approximately a right angle to provide a shelf for an index finger, as described and/or illustrated in EP-A-1175165, optionally with its head angled relative to its body.

The invention housing can be employed in a dispenser that is intended to be stored in an upright orientation, its bottle having a flat or concave base on which it can stand stably, or alternatively in a dispenser that is intended to be stored in an invert orientation, the cap having a flat or concave top on which it can stand stably. The respective cap top and bottle base can be shaped so as to prevent the dispenser being stored by itself stably in the other orientation, or of course both can be flat or concave so as to allow the consumer to choose which orientation is preferred.

Since the problem of variation in dosage of the liquid onto a intended surface is believed to apply during the application phase rather than during storage or ball-wetting phases, the instant invention is similarly applicable to dispensers which are intended to be stored in both an upright orientation or an invert orientation, because the ball needs to face and contact the target surface during application.

The cosmetic liquid that is dispensable from a cosmetic dispenser described herein desirably has a low to intermediate viscosity. That is to say that it is not so runny as to flow quickly from any surface to which it is contacted and not so viscous as to difficult to wipe from a surface. The cosmetic liquid is often selected within the range of from 1000 to 10,000 mpa·s (centipoise) and conveniently from 1,500 to 6,000 mPa·s. Viscosity herein conveniently refers to measurements by a conventional viscometer, such as a Brookfield viscometer at 25° C., RVT, TA, 20 rpm, Hellipath, unless otherwise stated, using a stirrer and stirrer speed that are appropriate for the specified viscosity range.

The cosmetic liquid may be a solution, for example an aqueous, or alcoholic solutions (including possibly dihydric or trihydric alcohols, if desired) for example of an astringent antiperspirant active which solutions are well known in deodorant or antiperspirant literature. Alternatively, the liquid can comprise an emulsion which may be an oil in water or a water in oil in emulsion depending on the relative proportions of the phases, their chemical nature and the choice of emulsifiers selected. Once again literature discloses examples of such cosmetic liquids. A further variation comprises a suspension of a fine particulate cosmetic active material in a suitable carrier liquid, which may for example by a water-immiscible liquid such as a volatile silicone and/or other cosmetic oil. The solution, emulsion or suspension may be thickened to any necessary extent by conventional thickeners known for such carrier fluids, including starch or cellulose derivatives, particulate clays, thickening polymers and waxes.

Having provided a detailed description of the present invention and a number of preferred embodiments, particular embodiments thereof will now be described with reference to the accompanying drawings in which.

Figure 1:
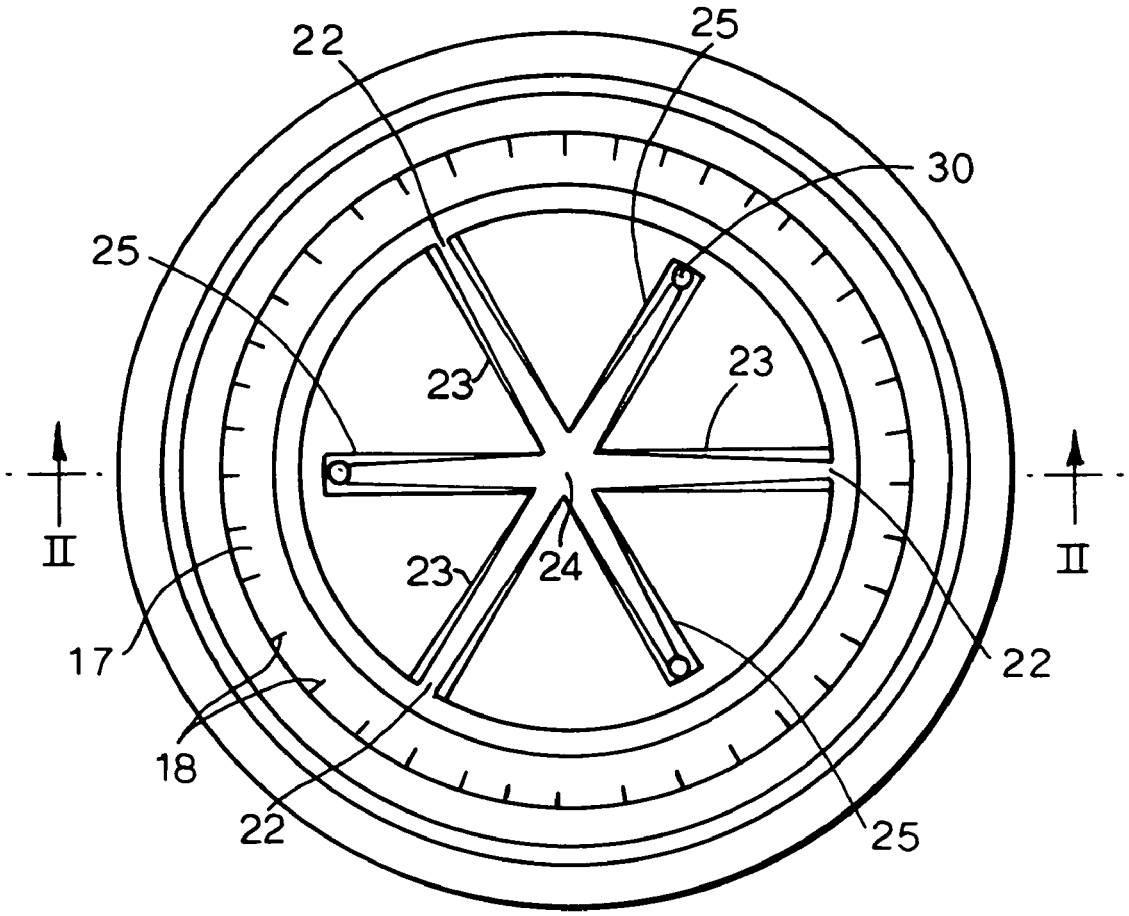
FIG. 1 is a plan view of a housing for a roll ball suitable for mounting on a cosmetic bottle, without the ball in place.
Figure 2:
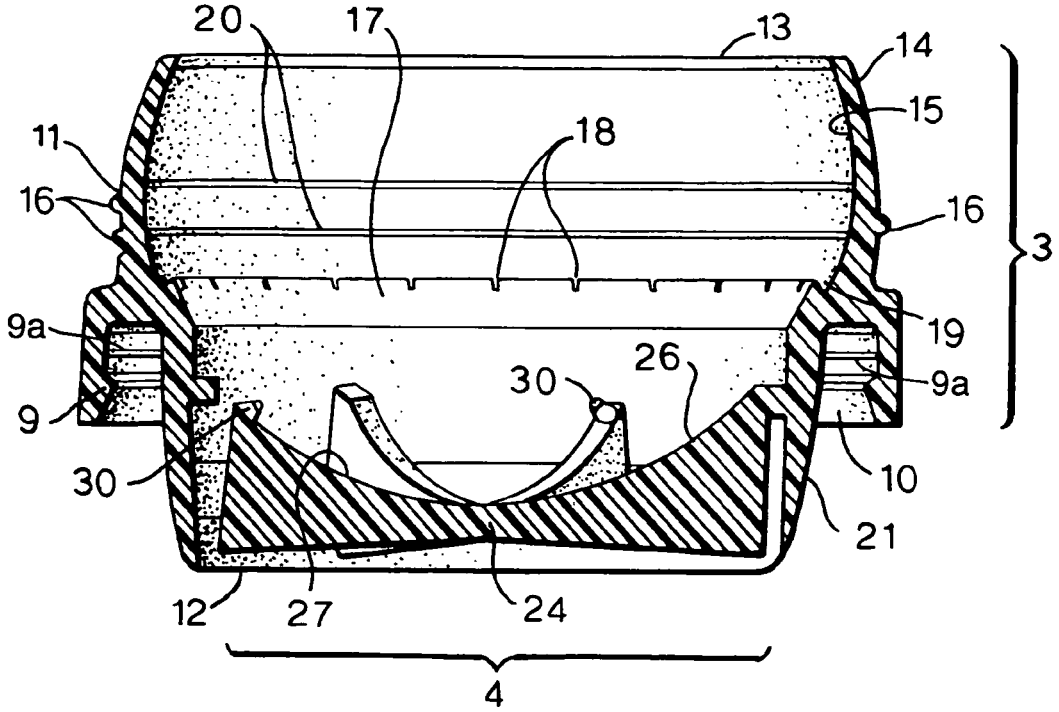
FIG. 2 is a cross section view of the housing of FIG. 1.
Figure 3:
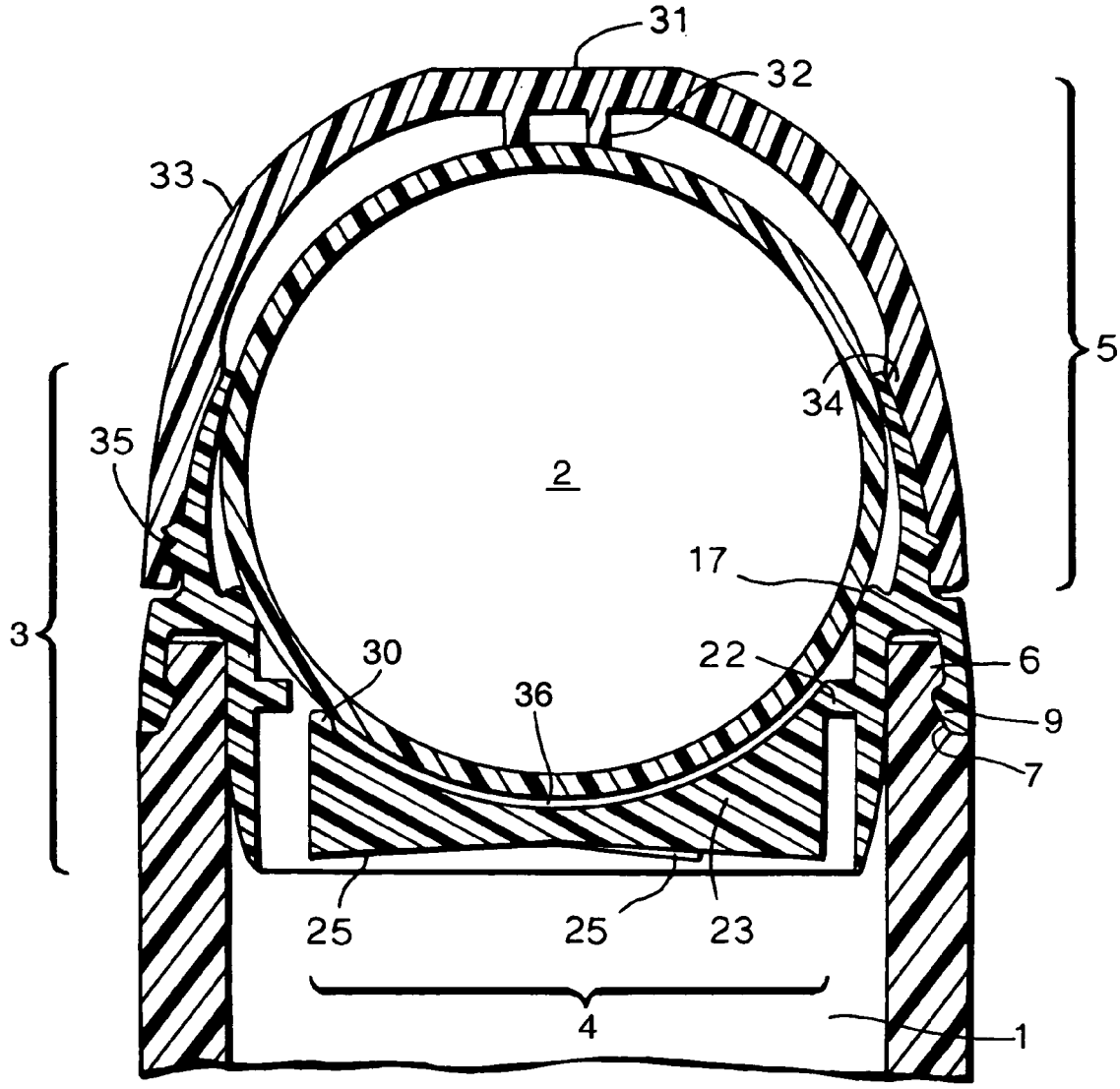
FIG. 3 is a cross section view of a dispenser showing the housing of FIGS. 1 and 2 with ball in place, mounted on a bottle and having a cap screwed tight.

As illustrated in FIGS. 1 to 3, the roll-on dispenser comprises a bottle (1) (bottle neck illustrated), a spherical ball (2), a housing (3) for the ball (2) integrally moulded with a spider (4) and a cap (5), each of which are moulded from a thermoplastic polymer.

The bottle (1) at its open end has an exterior annular lip (6) and annular groove (7) which snap fit with co-operating annular bead (9) moulding on the inward-face of an annular channel (10) formed by a bifurcated side-wall of the housing (3) dimensioned for a fluid tight fit with the bottle. Leakage is also minimised by a shallow v-shaped annular bead (9*a*) parallel with and above bead (9) within the bifurcated side-wall of the housing.

The housing (3) comprises an annular side-wall (11) of circular lateral cross section extending between an inward end (12) and an outward end (13). The side wall (11) comprises an upper wall of tapering cross section (14) which is flexible adjacent to the outward end (13). Side-wall (11) has a concave interior face (15) having two lateral shallow beads (20) and screw threads (16) on an exterior face. The shallow annular beads (20) act as baffles which perturbs air as it flows into the bottle across the interior face of the housing during use and thereby smoothes variations in the application of liquid. The housing (3) has a thickened middle wall section having an inward facing annular sealing ring (17) into the outward (upper) edge of which are cut a multiplicity of short notches (18) equidistantly spaced around the ring and extending down about 30% of the axial height of the sealing ring (17). The notches (18) disrupt the flow of air across the interior face of the housing. The notches (18) are of about the same depth as and in fluid communication with a lateral annular v-shaped groove (19) defined by an inward face of the upper wall (11) and an outward face of the ring (17). The groove (19) also provides a small intermediate reservoir for liquid when the dispenser is in an upright orientation.

The housing side-wall is bifurcated inward of the sealing ring (17), providing an inner annular skirt (21) that extends into the bottle (1) from the middle section of the housing (3). A spider (4) is mounted at three equidistant points (22) around the skirt (21), which spider (4) extends across the inward end (12) of the housing.

The spider (4) comprises three fixed arms (23) extending from mounting points (22) integrally moulded with the housing skirt (21) to a hub (24) from which radiates three free spokes (25) that each are equidistant from the adjacent fixed spokes (23) and extend about 90% of the distance from the hub to the interior face of the skirt. Each respective spoke (23), (25) has respective concave faces (26) and (27) that face the ball (2) in the housing which has a similar radius of curvature to that of the ball, and is of T-shaped cross section having a strengthening base flanges from which a tapering wall extends upwardly (not illustrated). Each free spoke has at it free end a pimple (30) proud of the concave face (27) which spaces that face (27) from the ball (2) and the pimples, being symmetrically arranged, centre the ball. The spokes (23, 25) act as wiper blades as the ball rotates.

The cap (5) has a top-wall (31) having a transverse flat outer surface enabling the dispenser to be stood in an invert orientation and an annular interior dependent wall (32) which can contact the ball (2) to urge it against the sealing ring (17) and a side-wall (33) having on its interior face a multiplicity of axially extending interior ribs (34) which can contact the upper wall (14 of the housing (3) and urge it against the ball (2) and on its exterior face a screw thread (35) for co-operation with a corresponding thread (16) on the housing (3). When the cap (5) is being fitted to the housing (3), the cap rotation around the housing is converted by the co-operating screw threads into relative axial movement, so that the ball (2) is urged by annular wall (32) towards the bottle (1) and in turn, the ball (2) being in contact with the pimples (30) on the free spokes (25) flexes the spider (4) and in particular the free spokes (25) towards the bottle (1). When the cap is removed, the spider and in particular the free spokes return to their rest positions due to their resilient character. In that rest position, the concave faces (26, 27) of the spokes (23) and (25) create with the ball outer surface an annular gap (36) of reasonably constant depth defined by the height of the pimples (30). When the dispenser is in its upright orientation and as the ball (2) rotates, it encounters the leading edges of the spokes (23) and (25) and excess liquid is wiped away leaving a film of desired thickness on the ball, the remainder falling back into the bottle (1).

Figure 4:
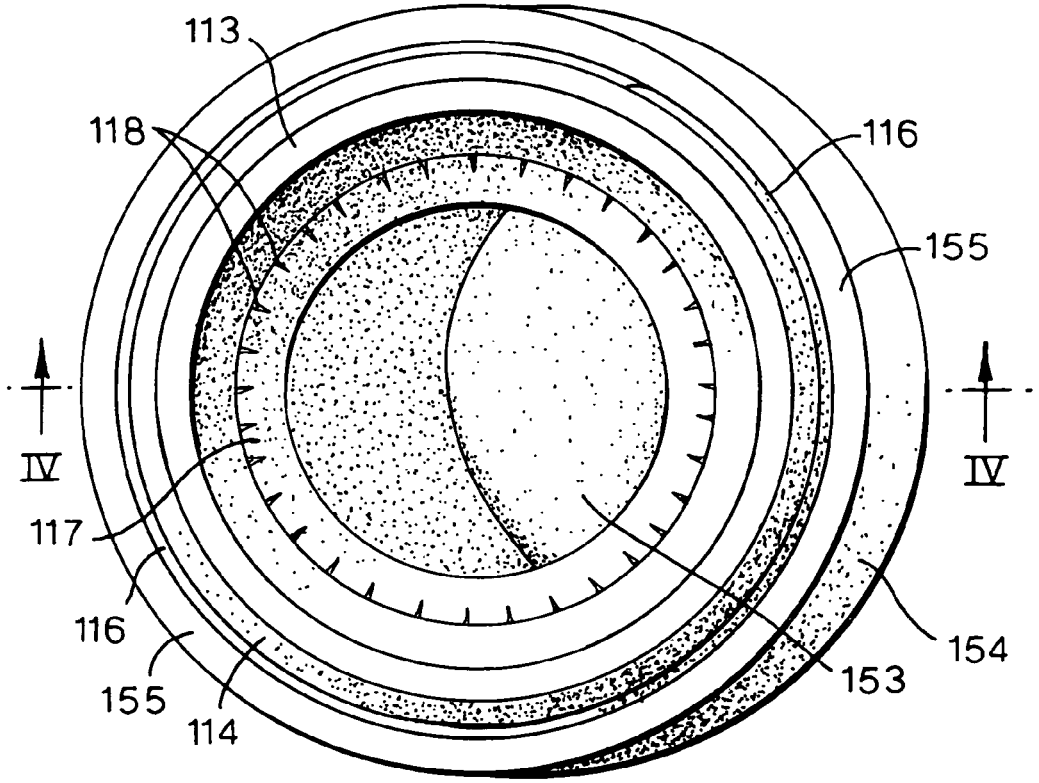
FIG. 4 shows in plan view an alternative embodiment comprising a unitary bottle reservoir and housing of FIG. 4.
Figure 5:
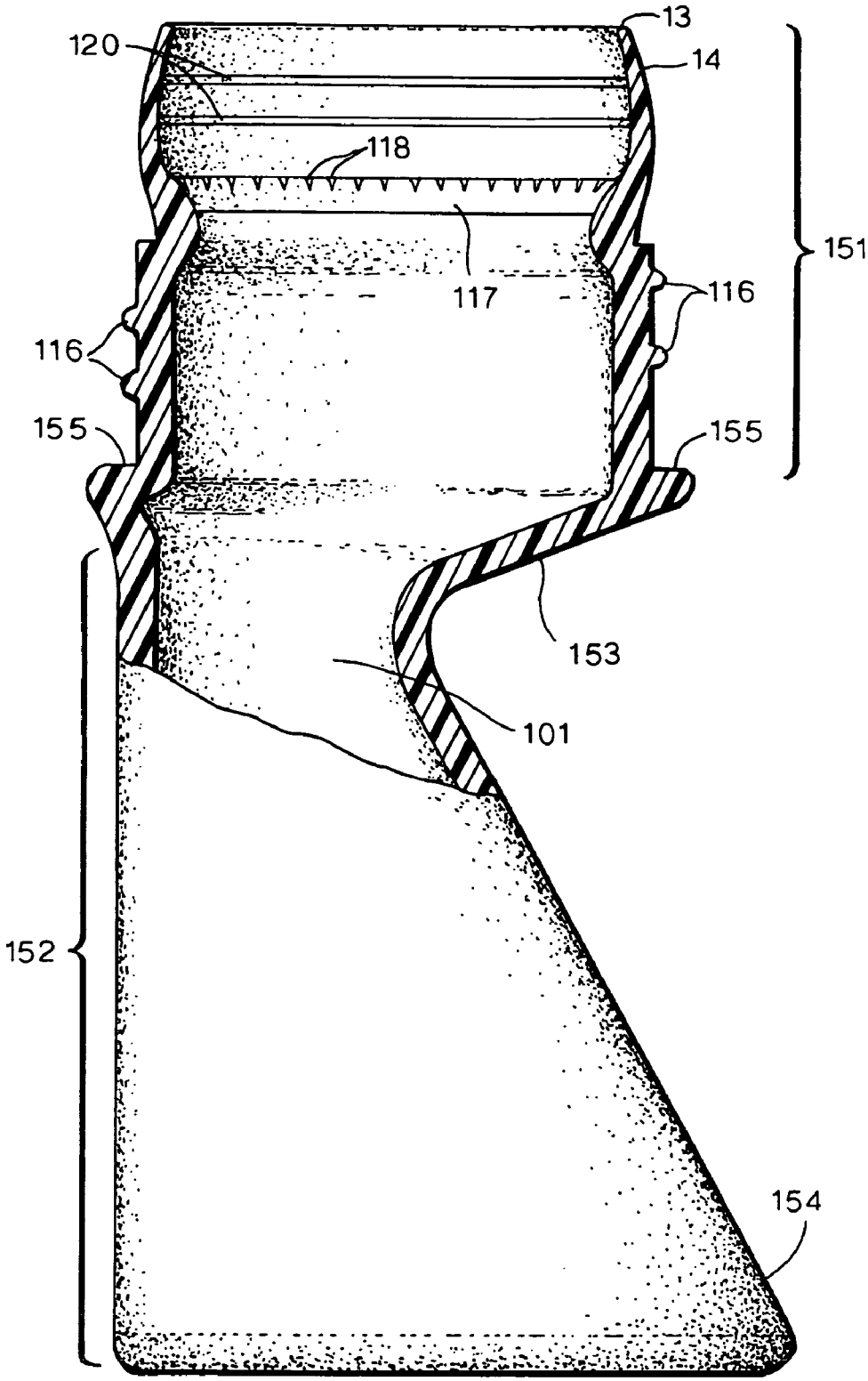
FIG. 5 shows in axial cross section the reservoir and housing of FIG. 4.

As illustrated in FIGS. 4 and 5, the bottle and housing are a unitary article (150) moulded by injection of polyethylene and comprising a head (151) located above a body (152). The head of circular lateral cross section provides a housing for a ball (not illustrated) similar to the ball (2) of FIGS. 1 to 3, and can be closed by a screw-threaded cap likewise similar to that (2) shown in FIG. 3, but having a longer side wall.

The ball housing of the unitary bottle/housing has an outward end circular aperture (113) defined by a flexible upper side-wall (114) of circular cross section and a concave interior surface on which are moulded two parallelbeads (120) which perturb the air-flow between the interior surface of the housing and the ball. The housing also has a lateral sealing ring (117) positioned between the lower bead (120) and the interior of the bottle (101) against which the ball (not illustrated) can be urged by the cap (not illustrated) to prevent egress of liquid when the cap is screwed tight. The sealing ring (117) has a multiplicity of notches (118) cut into the upward edge of the ring and defines with the housing side-wall (114) a v-shaped annular lateral groove.

The head (151) has a screw thread (116) on its outer surface for co-operation with a screw-treaded cap (not illustrated) a circumferential flange (155) that acts as a stop for the cap and a base wall (153) that extends at an acute angle in the region of 5 to 25 degrees to the horizontal approximately to the centre of the head from one side and defines with a sloping rear side-wall (154) of the body (152) an angle the region of 90 to 110 degrees to provide an ergonomically advantageous grasping position. The head base wall (153) can thereby readily provide a shelf to rest on the index finger of the hand that grasps the bottle when it is wrapped across sloping wall (154).

Figure 6:
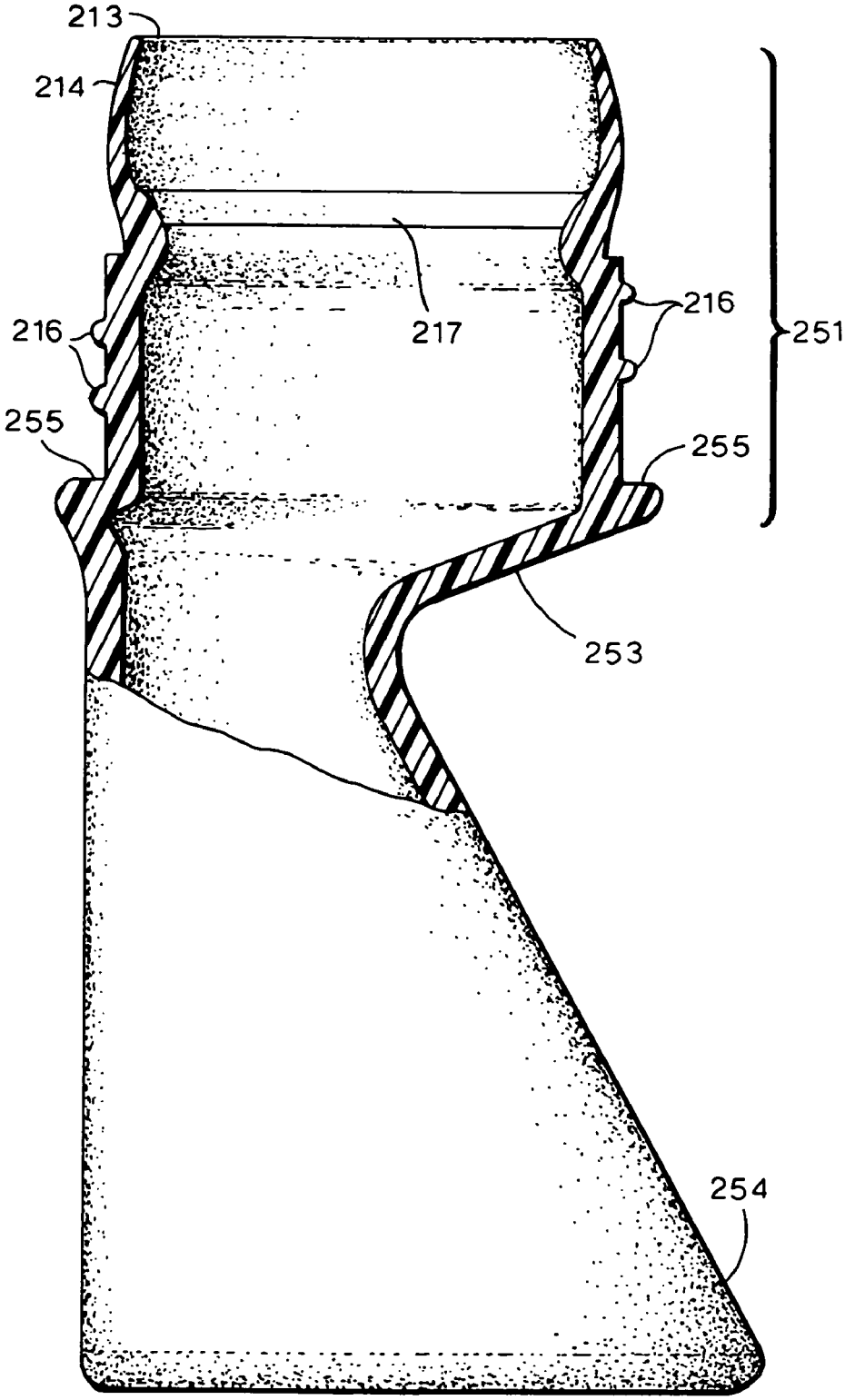
FIG. 6 shows in axial cross section a comparison bottle like that of FIGS. 4 an 5 in which perturbing beads are not present.

FIG. 6 illustrates the head of a prior art dispenser similar to that of FIGS. 4 and 5 but having a head which lacks the invention air-flow perturbators. The head (251) of the prior art dispenser shares common features of a circular mouth (213) defined by a side-wall of circular cross section having a similarly positioned sealing ring (217) and external screw threads (216), a circular external flange (255) to stop the cap (not illustrated) and an inclined base wall (253) that is integrally moulded with a body like that of FIGS. 4 and 5 having a sloping wall (254) that likewise intersects with inclined base wall to form a shelf to support the index finger when the hand grasps the body around wall (254).

The capability of the invention dispenser to smooth out the dose variations from a roll-on dispenser was measured by comparing the doses applied by an invention dispenser with that from a prior art dispenser like that of FIG. 6. The two dispensers were filled with the same volume of the same aqueous antiperspirant emulsion composition, the ball inserted and a cycle of applications was repeated. Each cycle comprised weighing the dispenser in an upright orientation with cap removed, inverting it, mounting it on an arm of a test rig with the axis of the ball housing pointed downwards, then wiping the ball for 350 mm across sandpaper (1200 grade) at a constant speed, inverting the dispenser back to an upright orientation and weighing it again. The difference was the weight that had been applied topically. The test rig applied a constant downward pressure of ~62 mPa. (9 psig), and the distance was a typical distance observed for users of roll-on applicators and the weight applied, aiming at about 0.3 g was a typical application dose. Successive passes each followed a fresh (but parallel) track on the sandpaper, spaced to avoid any liquid interaction during the pass.

The results were plotted. The first 15 cycles were not considered for this test because the dose from the prior art dispenser was still tending, on average, to increase, though the invention dispenser had attained a dose within its band of doses by the $6^{th}$ cycle.

From the resultant graphs, between the 15 and $150^{th}$ cycles, it was observed that the prior art dispenser had a peak application of 0.42 grams and a trough application of 0.17 grams, which can be represented as 0.29+/−0.13. From its $15^{th}$ to the $75^{th}$ cycle, the dose applied varied about an average of 0.29 grams whilst from the $75^{th}$ to $150^{th}$ cycles, the average dose applied tended to fall to an average of about 0.23 grams after 150 cycles. The greatest difference between successive cycles was a drop between 0.34 and 0.17 grams and an increase between 0.24 and 0.42 grams. Although experienced users of roll-on can potentially compensate for variations by either continuing dosing for longer, though it is much more difficult to terminate dosing earlier, the prior art dispenser afforded significant opportunity for the user to practice his own dose regulating skills.

On the other hand, the dispenser of the present invention during the same cycle period of 15 to 150 cycles had an average that was constant throughout, and like the prior art dispenser delivering on average about 0.29 grams per dose, but with a peak of 0.32 grams and a trough of 0.26 grams, i.e. 0.29+/−0.03. Clearly, the variation between peak and trough is substantially smaller than for the prior art dispenser. The greatest difference between successive cycles was from 0.31 to 0.28 grams from 0.27 to 0.30 grams, likewise being much smaller than the corresponding data for the prior art dispenser.

Accordingly, the invention dispenser with its perturbors demonstrated the following advantages over the prior art dispenser:

it reached a mean band faster, after 6 instead of 15 cycles;

it maintained a mean band for longer, over 150 instead of 75 cycles;

it had much smaller fluctuations between successive cycles, a maximum 0.03 grams instead of 0.18 grams and it had a much smaller difference between peak and trough doses of 0.06 grams instead of 0.25 grams.

The invention claimed is:

1. A roll-on dispenser for a liquid comprising a bottle and a removable cap, the bottle having an interior and a first end which defines a housing for a rotatable roller, said housing having a chamber within which the roller can rotate having an inward end in fluid communication with the interior of the bottle and comprising a lateral sealing shelf dimensioned to prevent the roller being urged into the interior of the bottle when subject to inward axial force, an opposed outward end dimensioned to retain the roller and a side-wall having an interior surface extending between the outward end and the inward end the roller having a segment projecting outside the housing, the cap having means to urge the roller axially towards the sealing shelf, wherein the sealing shelf comprises an annular ring having a multiplicity of axially extending notches at its upward edge, wherein the notches in the sealing shelf cause fluid flow perturbation.

2. A dispenser according to claim 1 which further comprises a baffle intermediate between the outward end of the housing and the sealing shelf.

3. A dispenser according to claim 2 in which the baffle comprises at least one lateral bead.

4. A dispenser according to claim 3 in which the baffle comprises two lateral beads.

5. A dispenser according to claim 3 in which the or each bead is continuous.

6. A dispenser according to claim 3 in which the bead has a height of from 50 to 500 μm.

7. A dispenser according to claim 1 in which the notches are spaced at a distance of from 2.5 to 7.5 mm.

8. A dispenser according to claim 1 in which the notches have a depth of out of from 500 to 2500 μm.

9. A dispenser according to claim 8 in which the notches have a depth of cut of from 1200 to 1600 μm.

10. A dispenser according to claim 1 in which the notches have a square edge.

11. A dispenser according to claim 1 in which the sealing shelf defines an outward-facing v- or u-shaped annular groove.

12. A dispenser according to claim 11 in which the sealing shelf has a depth of from 500 to 2500 μm.

13. A dispenser according to claim 1 in which the notches in the sealing shelf are in fluid communication with the v- or u-shaped annular groove.

14. A dispenser according to claim 13 in which the depth of the notches is the same as the depth of the v- or u-shaped annular groove.

15. A dispenser according to claim 1 in which the housing is a separate moulding from the bottle and additionally comprises a spider mounted between its inward end and the sealing shelf.

16. A dispenser according to claim 15 in which the spider is resiliently biased towards the roller providing localised contact therewith and comprises spokes having a roller-facing surface parallel with the roller.

17. A dispenser according to claim 1 in which the roller is a ball.

18. A dispenser according to claim 17 in which the ball is spherical.

19. A dispenser according to claim 1 in which the notches are spaced at a distance of from 3 to 5 mm.

20. A method of smoothing the dosage topically applied by a hand-held cosmetic roll-on dispenser comprising a housing defining a chamber within which a roller can rotate, having an outward open end dimensioned to permit a minor fraction of the roller to protrude therethrough and an inward annular sealing ring which method comprises perturbing fluid flow by means of a multiplicity of axially extending notches in the sealing ring at its upward edge.

21. A method according to claim 20 creating turbulent fluid flow for at least a fraction of the fluid pathway within the housing between the sealing ring and the outward open end.

22. A method according to claim 20 characterised in that the roller is a ball.

23. A method according to claim 22 in which the ball is spherical.

24. A method according to claim 18 in which the dispenser is as described herein.

* * * * *